US010542846B2

(12) United States Patent
Van Spengen

(10) Patent No.: US 10,542,846 B2
(45) Date of Patent: Jan. 28, 2020

(54) FLOW DRAIN FOR BATHING APPARATUS

(71) Applicant: NuWhirl Systems Corporation, Corona, CA (US)

(72) Inventor: Dale Van Spengen, Smith Falls (CA)

(73) Assignee: NuWhirl Systems Corporation, Corona, CA (US)

( * ) Notice: Subject to any disclaimer, the term of this patent is extended or adjusted under 35 U.S.C. 154(b) by 0 days.

(21) Appl. No.: 15/489,375

(22) Filed: Apr. 17, 2017

(65) Prior Publication Data

US 2017/0298604 A1 Oct. 19, 2017

Related U.S. Application Data

(60) Provisional application No. 62/324,835, filed on Apr. 19, 2016.

(51) Int. Cl.

| | |
|---|---|
| ***A47K 3/00*** | (2006.01) |
| ***E03C 1/22*** | (2006.01) |
| ***E03C 1/26*** | (2006.01) |

(52) U.S. Cl.

CPC ..... *A47K 3/00* (2013.01); *E03C 1/22* (2013.01); *E03C 1/26* (2013.01)

(58) Field of Classification Search

CPC .... A47K 3/00; E03C 1/22; E03C 1/24; E03C 1/26

USPC ..... 4/288, 650, 653, 679

See application file for complete search history.

(56) References Cited

U.S. PATENT DOCUMENTS

| | | | | | |
|---|---|---|---|---|---|
| 917,395 | A * | 4/1909 | Wise | E03C 1/24 | 285/133.11 |
| 938,102 | A * | 10/1909 | Wise | E03C 1/24 | 285/179 |
| 1,018,021 | A * | 2/1912 | Willetts | E03C 1/284 | 285/179 |
| 1,070,424 | A * | 8/1913 | Danver | E03C 1/22 | 285/42 |
| 1,584,986 | A * | 5/1926 | Fleming | E04D 13/0409 | 210/165 |
| 2,444,340 | A * | 6/1948 | Donahue | E03C 1/24 | 285/206 |
| 4,207,632 | A * | 6/1980 | Savell, Jr. | E03C 1/20 | 285/136.1 |
| 4,218,786 | A * | 8/1980 | Taglarino | E03C 1/24 | 137/247.25 |
| 4,594,739 | A * | 6/1986 | Watts | E03C 1/26 | 137/844 |
| 4,669,131 | A * | 6/1987 | Barlow | E03C 1/24 | 4/683 |
| 6,058,525 | A * | 5/2000 | Paden | E03C 1/24 | 4/287 |
| 6,546,573 | B1 * | 4/2003 | Ball | E03C 1/22 | 285/361 |
| 6,681,420 | B1 * | 1/2004 | Ball | E03C 1/22 | 4/680 |

(Continued)

*Primary Examiner* — Benjamin R Shaw

(74) *Attorney, Agent, or Firm* — Knobbe Martens Olson & Bear LLP

(57) ABSTRACT

This disclosure provides a drain fitting having a discharge potion comprising a chamber formed by walls extending between and around an inlet and an outlet, the inlet being wider than the outlet or having a greater cross-sectional area than the outlet and the walls having interior surfaces sloping inwardly between the inlet and outlet.

14 Claims, 4 Drawing Sheets

(56) References Cited

U.S. PATENT DOCUMENTS

| | | | | |
|---|---|---|---|---|
| 6,810,537 | B1 * | 11/2004 | Barnes | E04H 4/1236 137/362 |
| 6,890,427 | B2 * | 5/2005 | Self | E03C 1/20 210/163 |
| 8,438,807 | B1 * | 5/2013 | Cornwall | E03F 5/0407 4/288 |
| 8,713,724 | B1 * | 5/2014 | Goettl | E04H 4/1236 4/507 |
| 9,896,827 | B1 * | 2/2018 | Hsieh | E03C 1/232 |
| 2004/0034926 | A1 * | 2/2004 | Ball | E03C 1/22 4/680 |
| 2006/0075549 | A1 * | 4/2006 | Witzleben | E03C 1/04 4/671 |
| 2008/0005835 | A1 * | 1/2008 | Shipley | E03F 5/0407 4/695 |
| 2011/0000014 | A1 * | 1/2011 | Ball | E03C 1/2304 4/679 |
| 2012/0047646 | A1 * | 3/2012 | Park | E03C 1/292 4/688 |
| 2013/0180045 | A1 * | 7/2013 | Ball | E03C 1/24 4/680 |
| 2014/0201900 | A1 * | 7/2014 | Torres | A47K 3/006 4/556 |
| 2014/0289943 | A1 * | 10/2014 | Myers, II | E03C 1/26 4/288 |
| 2014/0299555 | A1 * | 10/2014 | Green | C02F 1/00 210/764 |
| 2015/0089736 | A1 * | 4/2015 | Bird | E03C 1/22 4/680 |

* cited by examiner

FLOW DRAIN FOR BATHING APPARATUS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

This disclosure is concerned with drain fittings and drain systems, which may be configured to optimize drain flow, particularly from baths and showers.

Description of the Related Art

A typical drain from a bath is 1½ inches in diameter, with the connection to waste, such as a sewer pipe, being the same diameter. This standard drain size limits the flow of water and therefore the draining of a bath. The rate of flow is further compromised by restrictions in the drain fitting, such as stopper systems and the like. Attempts to increase the drain size are limited by resistance to deviate from industry standards. More particularly, the reduction in diameter from a larger drain to a tail piece component that is 1½ inches in diameter poses various problems. This leads to connection designs that violate code requirements and provide less than optimal outflow, in view of the initial, larger size in the drain shoe that encourages a particular flow rate that then gets slowed by the reduction in size in the connection between the drain and the waste or sewer pipe. This problem has particular inconvenience for users of walk-in-baths, where the user has to wait for the bath to drain before the door in the walk-in-bath can be opened for exit.

Therefore, objects of this disclosure include connectors from a drain inlet to a waste or sewer pipe, which pipe has a diameter smaller than that of the drain inlet that, in use, meet local code requirements; and/or have improved flow characteristics over comparable such diameter reduction drains; and/or provide faster drain times for showers and baths than comparable such diameter reduction drains.

SUMMARY OF THE INVENTION

This disclosure provides a drain fitting having a discharge potion comprising a chamber formed by walls extending between and around an inlet and an outlet, the inlet being wider than the outlet or having a greater cross-sectional area than the outlet and the walls having interior surfaces sloping inwardly between the inlet and outlet.

The drain fitting can further comprise a connector portion having an outlet opening configured to be connected to a pipe for carrying water flowing through the drain fitting to a sewer system or elsewhere and walls forming a hollow body portion, which is in fluid communication with the outlet opening and the outlet of the chamber of the drain fitting. Conveniently, the walls of the chamber can merge with a wall or the walls of the body of the connector portion, for example around a hole in a wall of the body or by joining the walls of the body in a generally elbow shaped manner.

The chamber can have a shape that is generally that of a truncated cone.

The walls of the body portion of the connector portion can form a generally cylindrical shape.

This disclosure also provides a drain fitting or drain shoe comprising an inlet section having an opening and an outlet section having an opening, the inlet opening being larger than the outlet opening, walls extending around the inlet section and extending towards the outlet section, the walls having inner surfaces forming a generally conical section between the inlet section and the outlet section.

This drain fitting or drain shoe may further comprise a downstream section comprising an inlet in fluid communication with the outlet section and an outlet for connection to a sewer pipe or the like.

The drain fittings herein may have a central axis extending between the inlet/inlet section and the outlet/outlet section. The walls between the inlet/inlet section and the outlet/outlet section may be formed symmetrically around that axis.

The drain fitting herein may have a cable drain operating mechanism. For example, the drain inlet may have a fitting for receiving a pop-up drain filter and/or closure. The drain fitting may contain an actuator for opening and closing such a pop-up. Connected to the actuator may be a cable system for remote operation of a linkage mechanism for moving the actuator up and down. The mechanism may be located in the drain fitting or in a housing attached to of formed integrally with the drain fitting.

This disclosure also provides low profile drain fittings and drain shoes. These may be particularly suitable for use under showers or baths where space is limited. One way of achieving this where a pipe connector portion extends generally perpendicularly to the axis of the drain inlet is to minimize the length of the walls between that inlet and the walls that form the pipe connector portion.

Such fittings or drain shoes, as with others disclosed herein, can have interior walls and, optionally, exterior walls that converge or taper towards each other between the fitting or drain shoe inlet and outlet, more particularly about a central axis that extends through the drain inlet.

This disclosure also provides baths and showers incorporating the drain fittings and drain shoes disclosed herein. For example, this disclosure provides walk-in baths having the drain fittings and drain shoes disclosed herein to drain water from such baths.

This disclosure also provides a method of enhancing flow through a drain, particularly between a bath or shower and sewer pipe or the like, wherein the drain diameter in the shower or bath is larger than the diameter of the sewer pipe or the like, and in which the flow rate of water from the shower or bath is maximized, despite said reduction in size, by using a drain fitting or shoe described herein.

This disclosure provides drain fittings or drain shoes and systems containing them, such as drain kits and bath or shower installations that get as much water flowing into the drain tail piece as possible using an enlarged inlet to the drain fitting or drain shoe. The denominal diameter of the inlet to the drain fitting or drain shoe and therefore from the bath or shower is more than 1½ inches, for example, 2 inches, 2¾ inches, 2½ or 3 inches. The drain fittings and drain shoes of this disclosure are designed to satisfy the Universal Plumbing Code.

Getting as much water flowing into the drain tail piece as possible may be achieved by maximizing the size of the water inlet opening, which tends to negate the effect of structures causing flow restrictions, such as the support and mechanism for the pop up valve, and keeping the tailpiece unobstructed.

In connection with baths, the high flow characteristics of the drain fittings and drain shoes fill the overflow pipe as much as possible, which minimizes or eliminates air from becoming entrained in the water outflow, thereby providing a head or "tower" of water in the overflow pipe, which contributes to an increased static pressure the drives water into the sewer pipe or the like. With optimal enhanced drain flow, as per this disclosure, the height of the water tower in the overflow pipe may be almost to the level of the water in the bath.

This head of water, together with the water in the bath provides a gravity driven encouragement for water to flow efficiently out of the tailpiece, and into the sewer pipe or the like.

These systems may "flood" the drain tail pipe with full capacity gravity pressurized water. These systems typically minimize or substantially eliminate flow restrictions in the drain shoe or drain fitting.

This may be done in combination with opening up the bath water inlet channel in the drain shoes and drain fittings of this disclosure so that any physical restrictions such as support and the like are located in much larger opening for the bath water inlet into the drain shoe or drain fitting.

BRIEF DESCRIPTION OF THE DRAWINGS

Some preferred embodiments will now be more particularly described by reference to the accompanying drawings in which.

DETAILED DESCRIPTION OF THE PREFERRED EMBODIMENT

Figure 1:
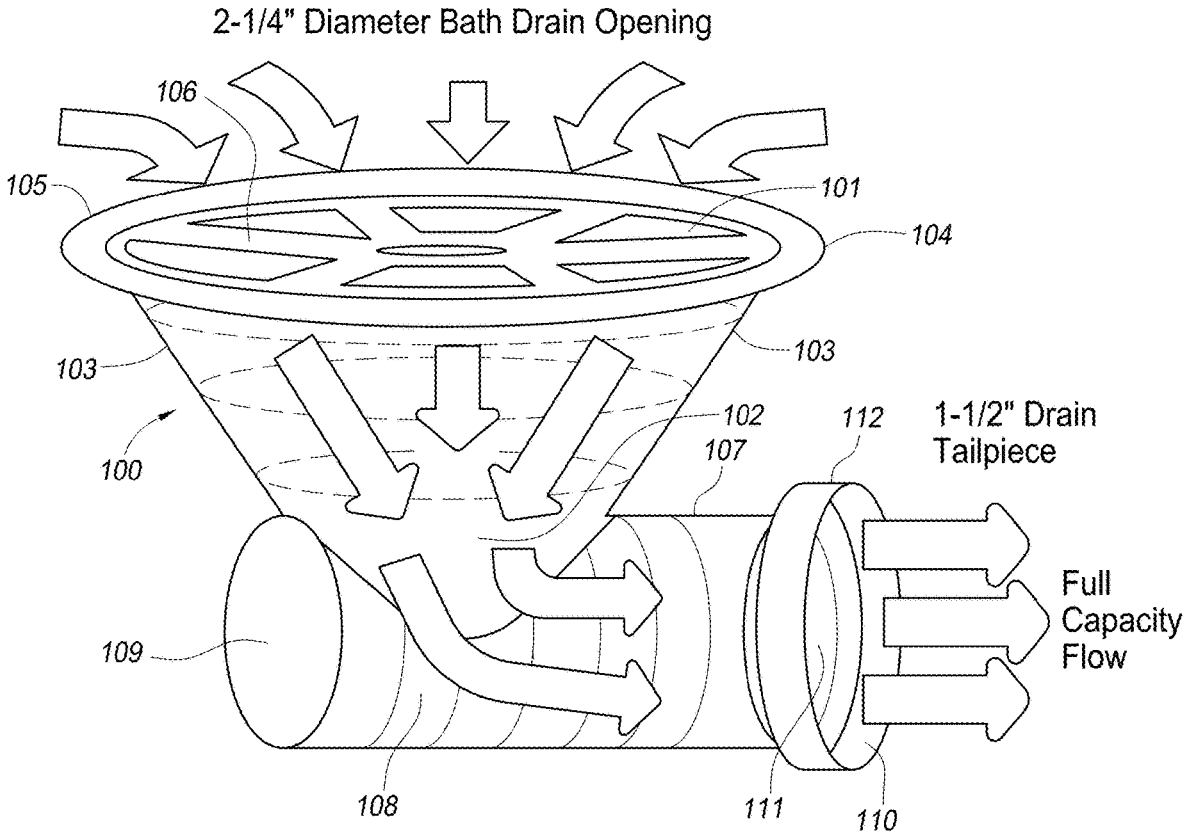
FIG. 1 is a schematic illustration of a drain fitting according to the invention.

Referring to FIG. 1, there is shown a drain fitting (100) comprising an inlet (101) and an outlet (102) having walls (103) there between. Inlet (101) typically has a circular periphery (104) and may have seated therein a waste plug assembly (105) with a strainer (106). Walls (103) slope gradually inwards from inlet (101) to outlet (102), preferably forming a generally truncated conical shape. Walls (103) merge into the walls (107) of a generally cylindrical short tube (108), typically having one end closed at (109) and the other end open at (101) having an outlet (111) to form a drain tail piece having a connector element (112) for attachment to a sewer or waste pipe (not shown).

Walls (103) function to gather water exiting a bath or shower or the like through a relatively large inlet (101) and, despite the reduction in flow area caused by the smaller cross-sectional area of tube (108), achieve full capacity flow from that tube.

Figure 2:
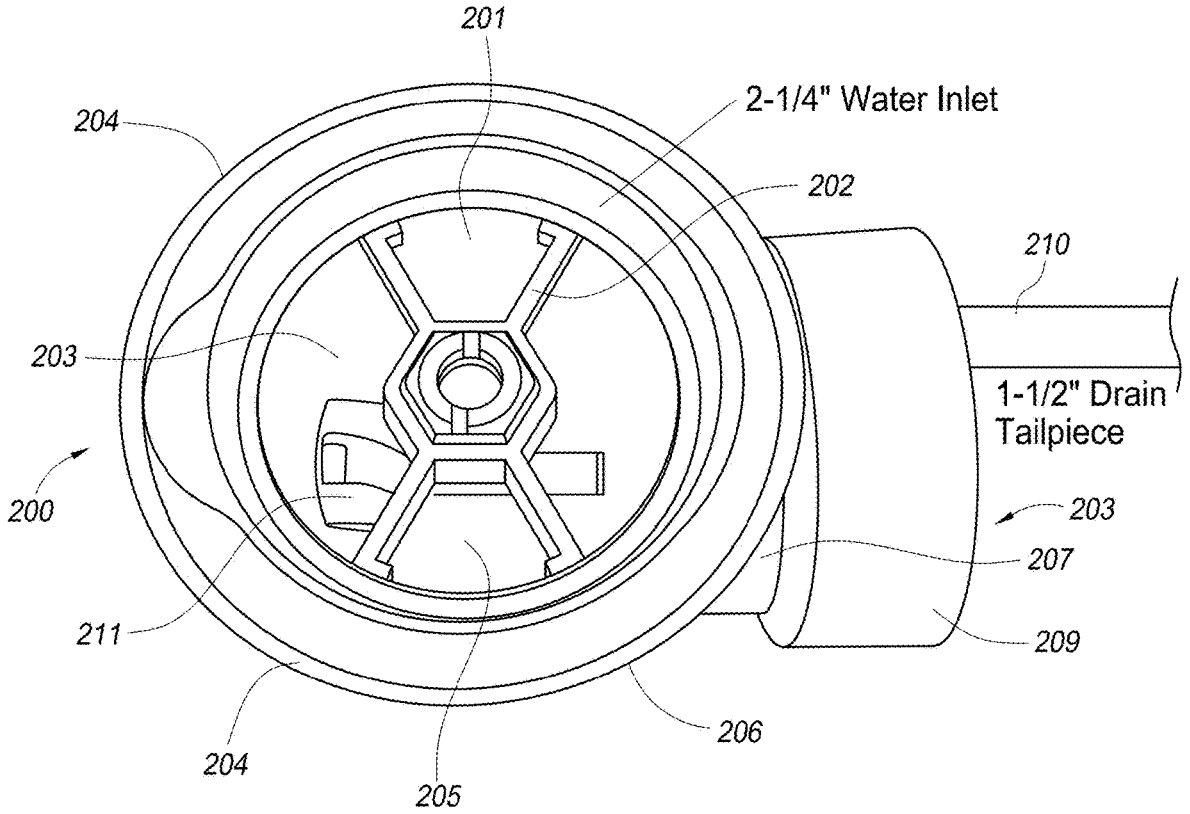
FIG. 2 is a top view of a drain fitting according to the invention.

Referring to FIG. 2, there is shown a drain fitting (200), according to this disclosure. Drain fitting (200) comprises an inlet (201) which is generally circular in cross section. Extending across the inlet (201) is a fitting (202) for receiving a drain closure (not shown).

Inlet (201) communicates with an internal chamber (203) formed by walls (204). As shown in FIG. 1, walls (204) converge or taper generally downwards towards outlet (205) to communicate with a tail piece fitting (206) comprising a cylindrical tube having an outlet (207) with an enlarged fitting (208) for connection to a sewer pipe.

A cable drain mechanism may be provided comprising a cable assembly (300) and an actuator (301) located at the bottom of chamber (203). In a conventional manner, cable assembly (210) operates actuator (211) to drive the closure upward and downward so as to open and close the water inlet.

Figure 3:
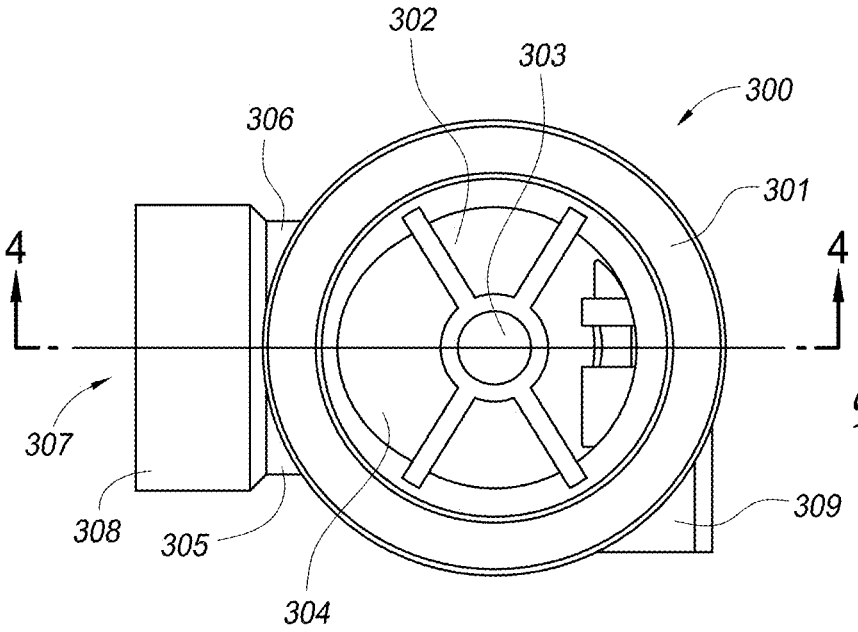
FIG. 3 is a top view of another drain fitting according to the invention.

In FIG. 3 there is shown a low profile drain fitting or drain shoe (300) comprising a plug assembly (301) that is intended to fit in the outlet of a shower or bath.

Plug assembly (301) comprises a fitting (302) having a central hole (303) for receiving a pop-up drain plug (not shown).

Fitting (301) provides a circular inlet (304) for water to flow into when in use draining a shower or bath. Inlet (304) is in fluid communication with a tail piece (305) extending generally perpendicularly to the central axis of inlet (304). Tail piece (305) comprises a generally cylindrical body (306) terminating in an outlet (307) formed by a connector portion (308), used for connecting to a waste or sewer pipe in a conventional manner.

Figure 4:
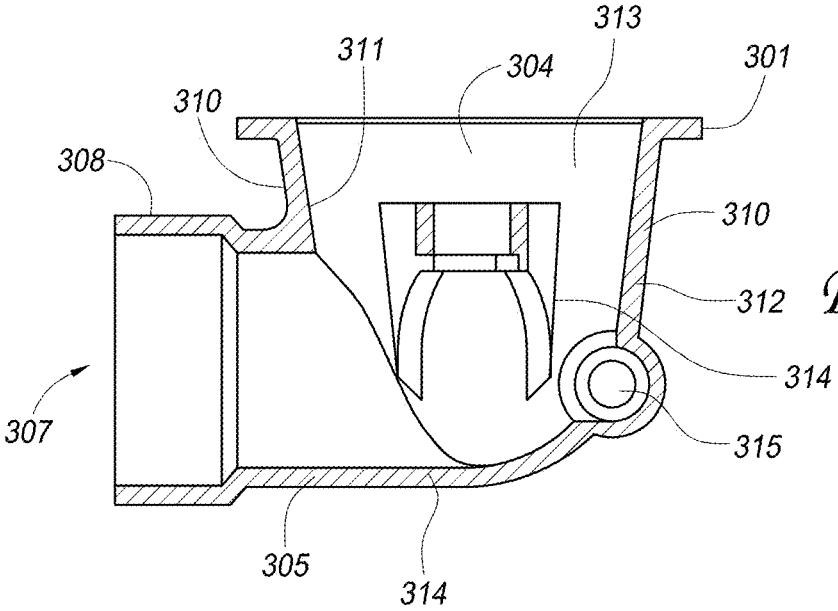
FIG. 4 is cross-sectional view of the drain fitting of FIG. 3 taken along the line 4-4 in the direction shown in FIG. 3.

The drain shoe in FIG. 3 further comprises a housing (309) for a cable mechanism (not shown) which can be used to open and close a pop-up closure (not shown). As can be seen in more detail in FIG. 4, fitting (301) comprises walls (310) that taper towards each other forming a generally frusto-conical shape that merges into the cylindrical body of the outflow connector (305). In order to make this embodiment a low profile drain shoe, wall (311) adjacent the outlet from the connector (305) is made relatively short and is substantially shorter than the opposing wall (312). Walls (311) and (312) form a chamber (313) which houses an assembly (314) for a pop-up valve (not shown). Adjacent the bottom wall (314) a connector portion there is provided a passageway (315) for receiving an actuator mechanism for the pop-up valve (not shown).

Figure 5:
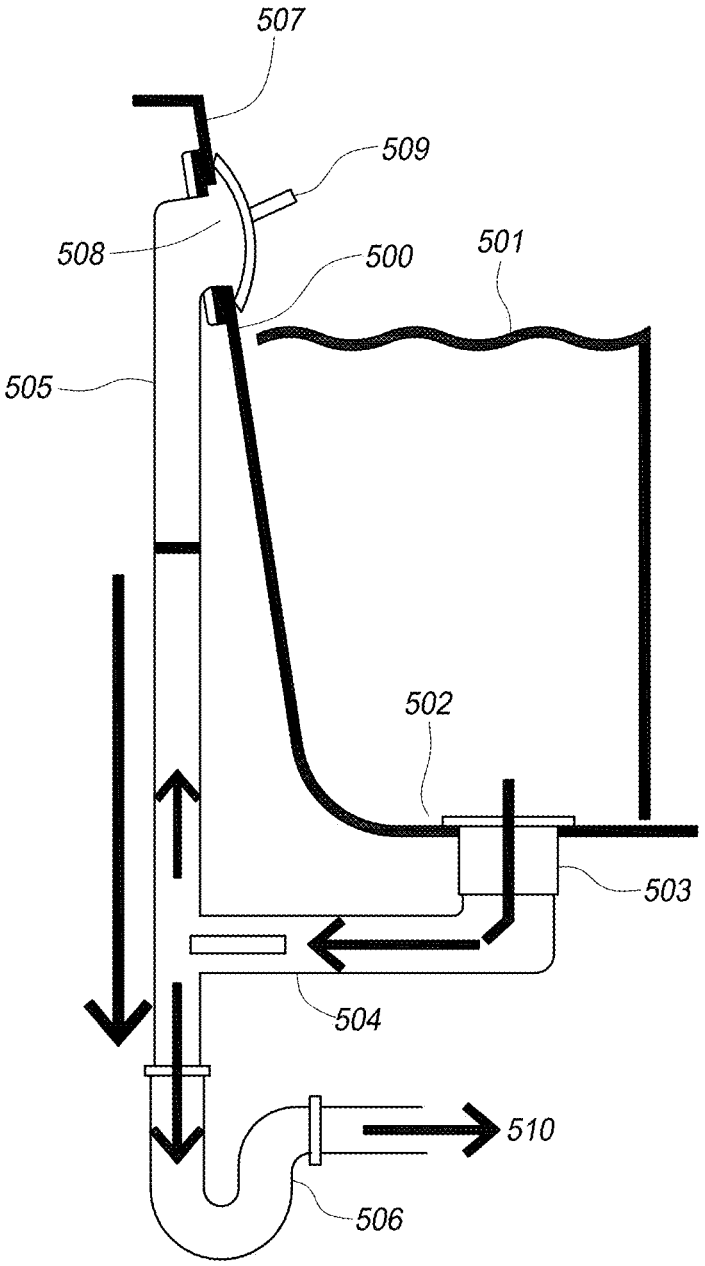
FIG. 5 is a schematic illustration of a bath draining through a drain shoe or drain fitting of this disclosure into a waste pipe and connected to a typical over flow pipe system.

Referring now to FIG. 5, there is shown a bath (500) containing water (501). The bath has an outlet (502) of which is connected to a drain fitting or drain shoe according to this disclosure (503).

A tail pipe (504) is connected to an overflow pipe (505) as well a pipe connection (506) to waste. Bath (500) has a wall (507) with a hole (508) receiving a conventional drain plug pop-up actuator (509).

When the Bath (500) is draining, the water in the bath produces a force on outgoing water. Similarly, water height in the overflow pipe (505) acts like a "water tower" and applies direct gravity force to the outgoing water in the drain pipe so that ultimately, for example at (510), the pipe system drains at full flow and gravity force and with preferably little or no trapped air and provide gravity pressure to accelerate the flow of the water into waste, such as a sewer pipe.

What is claimed is:

1. A drain fitting comprising:

a discharge portion comprising:

a chamber formed by a wall extending between and around a discharge inlet and a discharge outlet, the discharge inlet having an inside perimeter that is greater than the inside perimeter of the discharge outlet, and wherein the wall comprises an interior surface that slopes inwardly between the discharge inlet and the discharge outlet such that the insider perimeter of the chamber decreases from the discharge inlet to the discharge outlet; and a flange member, wherein the flange member annularly surrounds the discharge inlet and extends radially away from a center axis of the discharge outlet, wherein the flange member comprises an upper annular surface and a lower annular surface, and wherein lower annular surface is configured to be supported by a surface of a bathing apparatus;

a connector portion, wherein the connector portion comprises an annular wall forming a hollow body and a connector outlet that is configured to be connected to piping to direct fluid away from the drain fitting; and wherein the wall of the chamber merges with the connector portion at a diameter of the connector portion, and wherein a first cross-sectional flow area at the merger is larger than a second cross-sectional flow area of the hollow body.

2. The drain fitting of claim 1, wherein the chamber has a shape that is generally that of a truncated cone.

3. The drain fitting of claim 1, wherein the wall of the chamber merge with the connector portion around a hole in the annular wall of the connector portion.

4. The drain fitting of claim 1, wherein the wall of the chamber merges with the annular wall of the connector portion in a generally elbow shaped manner.

5. A drain shoe comprising:

an inlet, an outlet, and an wall extending between the inlet and outlet such that the wall converges about a central axis that extends through the inlet; and a flange member surrounding the inlet, wherein the flange member projects outwardly from the central axis, and wherein the flange member configured to be supported by a surface of a bathing apparatus;

a connector portion, wherein the connector portion has an annular wall forming a hollow body, wherein the connector portion comprises a connector outlet that is configured to be connected to piping to direct fluid away from the drain fitting;

wherein a center-longitudinal axis of the connector portion is perpendicular to the central axis, the center-longitudinal axis of the connector portion extending through a central extent of the hollow body and through the connector outlet; and wherein the wall merges with the connector portion such that a first cross-sectional flow area at the merger is larger than a second cross-sectional flow area of the hollow body, the center-longitudinal axis of the connector portion passing through the first cross-sectional flow area.

6. A shower or bath incorporating the drain fitting of claim 1.

7. The bath of claim 6, wherein the bath is a walk-in bath.

8. A bath comprising:

a base portion comprising a hole therethrough as a fluid outlet;

an inside surface;

a drain comprising:

a drain outlet and a drain inlet, the drain inlet comprises a diameter of more than 1½ inches, and wherein a wall extends between the drain outlet and drain inlet;

a flange member surrounding at least a portion of the drain inlet, wherein the flange member projects outwardly from the drain and is configured to interface with the drain outlet such that the flange member is supported by a surface of the bath;

an axis extending through a center of the drain outlet and a center of the drain inlet, and wherein the wall converges from proximate the drain inlet towards the axis;

a connector portion, wherein the connector portion comprises an annular wall forming a hollow body and a connector outlet;

wherein the wall merges with the connector portion at a diameter of the connector portion, and wherein a first cross-sectional flow area at the merger is larger than a second cross-sectional flow area of the hollow body;

an overflow pipe that is connected to the connector portion and is configured to connect to a waste fluid pipe; and wherein the drain inlet, drain outlet, and wall are configured to cause fluid to fill the overflow pipe to a height approaching a height of fluid in the bath, such that entrapment of air in the fluid during draining from the bath is reduced.

9. The drain fitting of claim 1, wherein the discharge inlet has a diameter of more than 1½ inches.

10. The drain fitting of claim 1, wherein the discharge inlet has a diameter of 2 to 3 inches.

11. The bath of claim 8, wherein the drain inlet has a diameter of 2 to 3 inches.

12. The drain fitting of claim 1, wherein a diameter of the chamber reduces up to the merger.

13. The drain fitting of claim 1, wherein a center-longitudinal axis of the connector portion is perpendicular to the center axis of the discharge portion, the center-longitudinal axis of the connector portion extending through a central extent of the hollow body and through the connector outlet.

14. The bath of claim 8, wherein a cross-sectional flow area defined by the wall reduces up to the merger.

* * * * *